United States Patent [19]

Dively

[11] 4,049,067

[45] Sept. 20, 1977

[54] CUTTER MOUNTING EXTENSION APPARATUS

[75] Inventor: Charles R. Dively, Seattle, Wash.

[73] Assignee: Ingersoll-Rand Company, Woodcliff Lake, N.J.

[21] Appl. No.: 629,052

[22] Filed: Nov. 5, 1975

[51] Int. Cl.[2] ..... E21B 9/22

[52] U.S. Cl. ..... 175/406; 175/53; 175/384; 175/391

[58] Field of Search ..... 175/53, 413, 406, 384, 175/374, 345, 334, 335, 391, 392, 412, 299/90

[56] References Cited

U.S. PATENT DOCUMENTS

| | | | |
|---|---|---|---|
| 2,745,650 | 5/1956 | Smith | 175/413 X |
| 2,818,242 | 12/1957 | Smith | 175/413 X |
| 2,887,300 | 5/1959 | Meredith | 175/406 X |
| 3,659,659 | 5/1972 | Lichte | 175/53 |
| 3,659,660 | 5/1972 | Conn | 175/53 |
| 3,858,667 | 1/1975 | Goodfellow | 175/345 X |
| 3,902,562 | 9/1975 | Pessier et al. | 175/53 |
| 3,917,009 | 11/1975 | Dyer | 175/53 |
| 3,921,734 | 11/1975 | Goodfellow | 175/374 |

*Primary Examiner*—Ernest R. Purser
*Assistant Examiner*—Richard E. Favreau
*Attorney, Agent, or Firm*—Bernard J. Murphy

[57] ABSTRACT

The apparatus comprises means for coupling to a standard raise boring head for extending the radius of the head. The apparatus comprises a support which is bolted or welded to a terminal end of the raise boring stem and to the underlying surface of the principal cutter bracket mounting platform of the head, and the support has means for selectively coupling thereto cutter mounting extension elements each of which comprise ancillary cutter bracket mounting platforms.

25 Claims, 2 Drawing Figures

CUTTER MOUNTING EXTENSION APPARATUS

This invention pertains to raise boring heads and in particular to means for extending the radius of raise boring heads in order that the same can ream or bore enlarged raises.

In raise boring operations it is frequently impossible to transport, through a subterranean tunnel or channel, a raise boring head of sufficient diameter to meet the boring or reaming requirements for a particular raise. Of course, it is neither prudent nor economical to enlarge such channels or tunnels, simply in order to be able to transport a sufficiently large raise boring head therethrough, to the location of a pilot bore (where the head can be joined to the stem, to ream and form the raise). Rather, it is preferable to employ a smaller standard raise boring head, which is readily transportable through a constricted tunnel and, at the pilot bore site, enlarge the radius of the head so that it will meet the raise boring requirements. Therefore, it is an object of this invention to set forth means for extending the radius of a raise boring head. In particular it is an object of this invention to disclose cutter mounting extension apparatus, for extending the radius of a raise boring head, comprising extension support means for coupling thereof to a raise boring head; and a cutter mounting extension element coupled to said support means. Another object of this invention is to set forth the combination of a raise boring head, having a stem, and a principal cutter bracket mounting platform; and a structure fastened to an underlying surface of said platform for reinforcement of said platform; wherein said structure comprises means for replaceably coupling thereto an ancillary cutter bracket mounting platform. Yet a further object of this invention is to teach a cutter mounting extension element, for extending the radius of a raise boring head, comprising first means defining a cutter bracket mounting plate; second means defining at least one, cutter bracket mounting pad on said plate; said at least one pad having a cutter axis; and means extending from one of said first and second means for coupling said cutter mounting extension element to a raise boring head.

Figure 1:
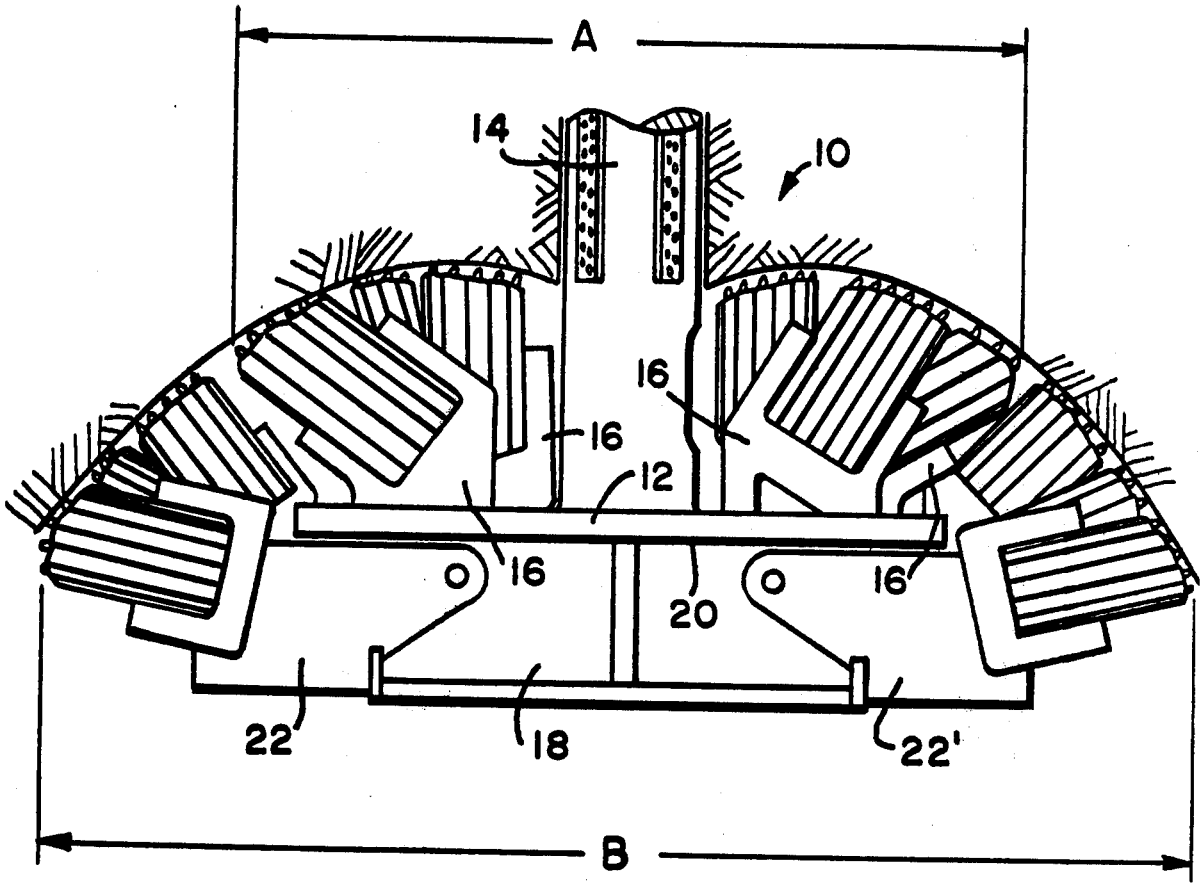
Figure 2:
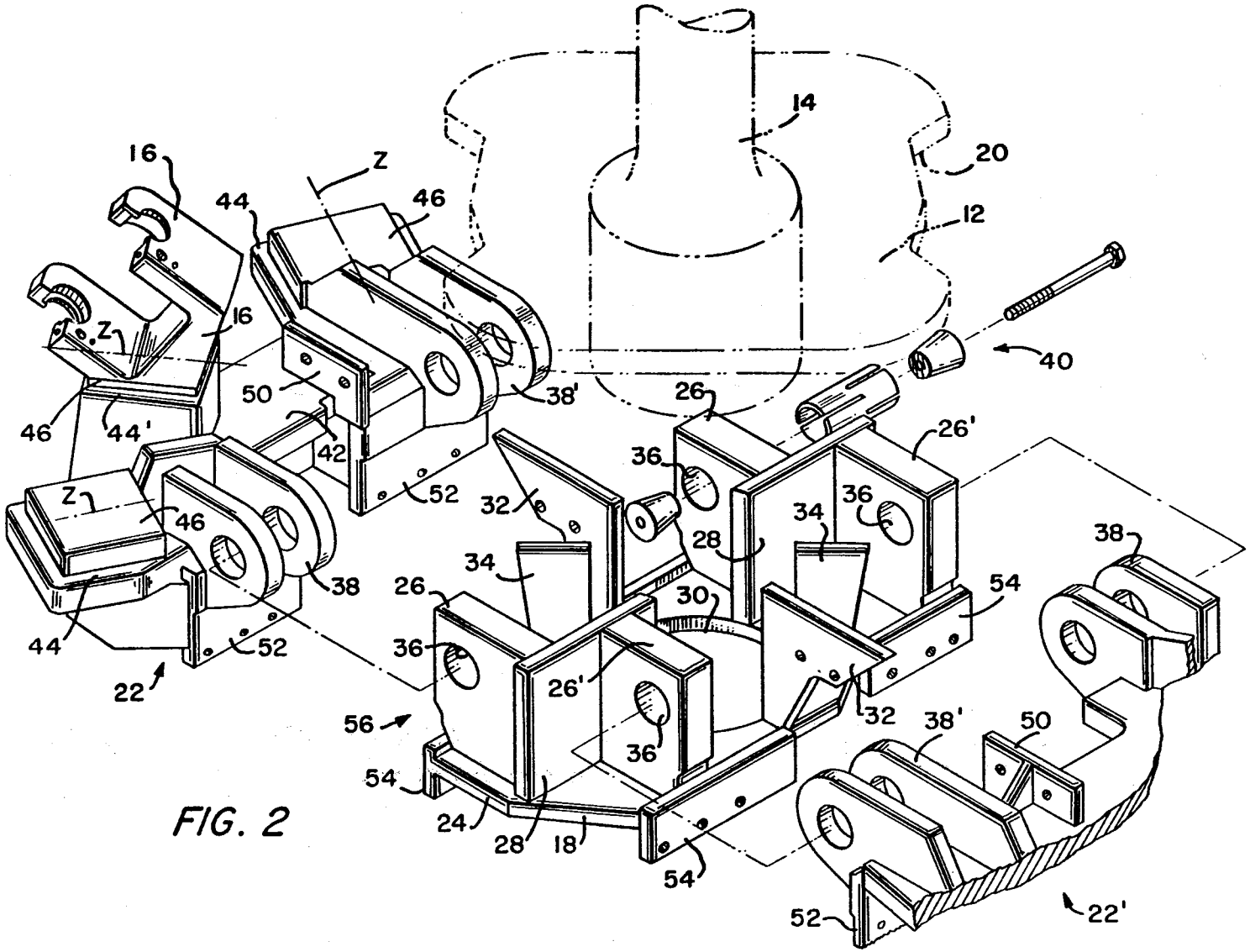

Further objects of this invention, as well as the novel features thereof, will become more apparent by reference to the following description taken in conjunction with the accompanying figures, in which:

FIG. 1 is a general outline illustration, in side elevation, of a standard raise boring head to which extension apparatus, according to an embodiment of the invention, has been attached so that the standard head will have an extended boring radius; and FIG. 2 is an exploded, isometric illustration of the embodiment of the extension apparatus of FIG. 1 shown in association with the stem and principal cutter bracket mounting platform of a standard raise boring head, the latter being shown only in phantom.

As shown in the Figures, a standard raise boring head 10 comprises a principal cutter bracket mounting platform 12 which is supported by a stem 14, the platform receiving thereon a plurality of roller cutter mounting brackets 16. The standard head 10 has a maximum diameter A and, in order to increase the radius (and diameter) of the standard head, an extension support 18 is welded to the undermost side 20 of the principal platform. In turn, then, the support 18 may selectively couple thereto cutter mounting extension elements 22 and 22'. With the addition of the latter, the boring diameter is increased to B.

The support 18, as FIG. 2 shows, comprises a base member 24 to which are fixed a plurality of walls 26, 26' and 28, each of said walls being fixed at one end thereof to the base 24 and the other ends thereof are welded to the underlying surface 20 of the principal platform 12 to reinforce the latter. Each of the walls is welded to another thereof, at an angle, where, as shown in FIG. 2, three walls to each side of the support 18 define, roughly, a Z or S pattern. In the center of the support there is formed an aperture 30 in which the terminal end of the stem 14 is received. A pair of the walls 28 at either side of the aperture 30, and right-angular weldments 32, also fixed in adjacency to the aperture 30, have upstanding lateral edges for abutting the stem 14, and are welded thereto. The uppermost edges of the weldments 32, like walls 26, 26' and 28, are welded to the underlying surface 20 of platform 12. In addition, a pair of gussets 34 also are fixed to the base 24, welded to the underlying surface 20 of platform 12, and these gussets too have lateral edges which align with the periphery of aperture 30 and are welded to the stem 14.

Four of the upstanding walls 26 and 26' have large bores 36 formed therein. These four walls comprise tongues which are received by clevises 38 and 38' extending from the cutter mounting extension elements 22 and 22'. The tongues and clevises are joined and fixed together by means of expansion bolts 40, only one thereof being shown in exploded view.

Each of the extension elements 22 and 22' comprises a plate 42 which serves as an ancillary cutter bracket mounting platform. The plate has a plurality (and in the embodiment shown, three) of platforms 44 and 44' for supporting cutter brackets. The platforms further include pads 46 which are welded thereto to which cutter brackets 16 are secured also by welding or replaceable hardware.

Each of the pads 46 has a centrally located cutter axis Z and, as can be seen in FIG. 2, the axes of the pads are angularly disposed relative to each other. The axes Z in fact are disposed along direct radial lines from the stem center line. Thus, cutters fixed to the pads 46 by means of brackets 16 become arrayed in a generally arcuate pattern. Additionally one of the platforms 44' defines a mounting surface which is in a plane other than those in which the other two pads are located; platform 44' is elevated relative to platforms 44. Now, this is arbitrary, and is provided depending upon the kind of cutter array or pattern desired, or, depending upon the type of cutting profile it is desired to effect (in the extended raise boring head). According to U.S. Pat. No. 3,805,901, issued on Apr. 23, 1974, to William D. Coski, for an "Earth Cutter Assembly," the patented assembly set forth a pattern of roller earth cutters which defined at least one overall circular and convex cutting surface. In the extension apparatus embodiment depicted herein, the elevated platform 44' on each of the extension elements 22 and 22' and the fixing of the extension support 18 to the underlying surface 20 of the principal cutter bracket mounting platform 12 cooperate generally to preserve the advantageous and novel convex cutting surface for the raise boring head 10 (as taught by patentee Coski). Nevertheless, it is the broader teaching of this invention simply to disclose means for extending the radius of a raise boring head, with or without a cutting profile such as that taught by Coski.

Right-angular weldments 32 have bolt holes formed therein and slidably engage vertical weldments 50, which also have bolt holes therein, to assist the coupling of elements 22 and 22' to support 18. So also, weldments 52 fixed to plates 42 are apertured to accommodate bolts and to abut like-apertured weldments 54 which are fixed to base 24.

As noted earlier, a standard raise boring head would comprise a stem 14, platform 12 (with roller cutters and brackets thereon) and a structure 56 (indicated by the arrow, FIG. 2) fixed thereto — first, for reinforcement of the platform 12, and second, for optional coupling thereto of extension elements 22 and 22'.

It is this standard head, then, which will have the boring diameter A, and which is optionally extendable, by means of extension elements 22 and 22', for the boring diameter B. The standard head and extension elements are readily passed along constricted tunnels, in disassembled condition, and can quickly and easily be assembled at the pilot bore site to define the larger boring diameter.

While I have described my invention in connection with a specific embodiment thereof it is to be clearly understood that this is done only by way of example and not as a limitation to the scope of my invention as set forth in the objects thereof and in the appended claims.

I claim:

1. Cutter mounting extension apparatus, for use in extending the radius of a raise boring head having a drive stem, comprising:

extension support means having means adapted for a coupling thereof to a raise boring head; and a cutter mounting extension element coupled to said support means; wherein said extension support means comprises a planar base having a pair of opposed sides;

said extension element comprises a flat plate;

said extension element is coupled to said base at one of said sides thereof;

said base and said plate being in abutting relationship and occupying a common plane; and fastening means replaceably securing said base and said plate together and prohibiting relative displacement, between said base and said plate, from said common plane.

2. Apparatus, according to claim 1, wherein:

said extension element has at least one cutter bracket mounting platform.

3. Apparatus, according to claim 1, in combination with a raise boring head, wherein:

said support means is secured to said raise boring head.

4. Apparatus, according to claim 1, in combination with a raise boring head, wherein:

said support means is secured to said raise boring head; and a plurality of said cutter mounting extensions are replaceably coupled to said support means.

5. Apparatus, according to claim 1, wherein:

said extension element has a plurality of cutter bracket mounting platforms.

6. Apparatus, according to claim 5, wherein:

said platforms include mounting pads having planar, cutter bracket mounting surfaces; and at least two of said surfaces lie in separate planes.

7. Apparatus, according to claim 6, wherein:

said pads are substantially rectilinear; and proximate sides of adjacent pads are angularly disposed relative to each other.

8. Apparatus, according to claim 5, wherein:

said support means and said extension element have mutually engaging means which cooperate to couple said element to said support means.

9. Apparatus, according to claim 8, wherein:

said mutually engaging means comprises first means defining a clevis, and second means defining a tongue engaged by said clevis;

one of said first and second means being borne by said element and the other thereof being borne by said support means; and an expansion pin replaceably fastened in penetration of said engaged clevis and tongue.

10. Apparatus, according to claim 9, wherein:

said first and second means comprise means which cooperate to couple said element to said support means in cantilevered fashion.

11. Apparatus, according to claim 9, wherein:

said element carries a pair of clevises on one side thereof and said pads are disposed on the opposite side thereof.

12. Apparatus, according to claim 9, wherein:

said support means carries a pair of tongues on one side thereof, and further includes means adapted for engaging a portion of a drive stem of a raise boring head.

13. Apparatus, according to claim 12, wherein:

said stem portion engaging means comprises an aperture formed in said support means for receiving therewithin a portion of a drive stem of a raise boring head.

14. Apparatus, according to claim 13, in combination with a raise boring head, wherein:

said support means is welded to an underlying surface of said raise boring head and the stem of said raise boring head is in penetration of said aperture.

15. In combination, a raise boring head having a stem and a first cutter bracket mounting platform; and a structure fastened to an underlying surface of said platform for reinforcement of said platform; wherein said structure comprises means adapted for replaceably coupling thereto a second cutter bracket mounting platform; wherein said structure has a planar surface which is terminated by a pair of opposed, lateral sides of said structure;

said coupling means comprises means for selectively coupling a second cutter bracket mounting platform thereto at one of said sides of said structure, in an abutting relationship with said structure, and in a plane common to said planar surface; and said coupling means further comprises means for selectively fastening such a second cutter bracket mounting platform to said one side of said structure secure against displacement of such a fastened second mounting platform from said common plane.

16. The combination, according to claim 15, wherein:

said structure includes a base member and a plurality of upstanding walls;

each of said walls is secured at one end thereof to said base member and at the other end thereof to said first mounting platform; and each of said walls is further secured to at least one other of said walls at an angle relative to said one other wall.

17. The combination, according to claim 16, wherein:

a plurality of said walls are fastened, lengthwise, to said stem and, relative to said stem's axis, extend radially therefrom.

18. The combination, according to claim 16, wherein:

said coupling means comprises expansion-pin-receiving apertures formed in a first plurality of said walls, and fastener-receiving bore holes formed in a second plurality of said walls.

19. The combination, according to claim 18, further including:

a plurality of flat weldments secured to said base member; and wherein said coupling means further comprises fastener-receiving bore holes formed in said flat weldments.

20. A cutter mounting extension element, for extending the radius of a raise boring head, comprising:

first means defining a flat, planar, cutter bracket mounting plate having a pair of opposed, lateral sides;

second means defining at least one, cutter bracket mounting pad on said plate;

said at least one pad having a cutter axis;

one coupling means, disposed along one of said sides of said pair, for receiving fasteners for selectively and replaceably coupling said plate to a raise boring head; and another coupling means, extending from said one side of said pair for receiving fasteners for selectively and replaceably coupling said plate to a raise boring head.

21. A cutter mounting extension element, according to claim 20, wherein:

said second means defines a plurality of cutter bracket mounting pads on said plate;

each pad of said plurality thereof has a cutter axis; and said pad cutter axes are angularly disposed relative to each other.

22. A cutter mounting extension element, according to claim 20, wherein:

said second means defines a plurality of cutter bracket mounting pads on said plate;

each of said pads has a planar mounting surface on which to receive a cutter bracket; and at least two of said mounting surfaces lie in separate planes.

23. A cutter mounting extension element, according to claim 20, further including:

a cutter mounting bracket fixed to said at least one pad.

24. A cutter mounting extension element, according to claim 23, wherein:

said cutter mounting bracket has a pair of cutter-shaft-receiving recesses formed therein, and means cooperative with said at least one pad for disposing said recesses in a diagonal inclination relative to said mounting plate.

25. In combination, a raise boring head having a stem and a first cutter bracket mounting platform; and a structure fastened to an underlying surface of said platform for reinforcement of said platform; wherein said structure comprises means adapted for replaceably coupling thereto a second cutter bracket mounting platform; wherein said structure includes a base member and a plurality of upstanding walls;

each of said walls is secured at one end thereof to said base member and at the other end thereof to said principal mounting platform; and each of said walls is further secured to at least one other of said walls at an angle relative to said one other wall.

* * * * *